US011842865B2

(12) United States Patent
Kawashima et al.

(10) Patent No.: US 11,842,865 B2
(45) Date of Patent: Dec. 12, 2023

(54) ELECTROMAGNETIC CONTACTOR

(71) Applicant: FUJI ELECTRIC FA COMPONENTS & SYSTEMS CO., LTD., Konosu (JP)

(72) Inventors: Shigenori Kawashima, Konosu (JP); Yukinari Furuhata, Konosu (JP); Haruki Shoji, Saitama (JP); Masayoshi Sakata, Yokohama (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 17 days.

(21) Appl. No.: 17/564,760

(22) Filed: Dec. 29, 2021

(65) Prior Publication Data

US 2022/0122790 A1 Apr. 21, 2022

Related U.S. Application Data

(63) Continuation of application No. PCT/JP2020/043631, filed on Nov. 24, 2020.

(30) Foreign Application Priority Data

Jan. 21, 2020 (JP) ..... 2020-7663

(51) Int. Cl.
*H01H 33/08* (2006.01)
*H01H 50/02* (2006.01)

(52) U.S. Cl.
CPC ..... *H01H 33/08* (2013.01); *H01H 50/02* (2013.01)

(58) Field of Classification Search
CPC ..... H01H 33/08
(Continued)

(56) References Cited

U.S. PATENT DOCUMENTS 878,634 A * 2/1908 Hubbell ..... H01H 9/02 439/753
4,719,542 A * 1/1988 Lemmer ..... H02B 1/052 248/222.12
(Continued)

FOREIGN PATENT DOCUMENTS

JP 62905 U 1/1994
JP 7282705 A 10/1995
(Continued)

OTHER PUBLICATIONS

International Search Report dated Feb. 16, 2021 from International Application No. PCT/JP2020/043631.
(Continued)

*Primary Examiner* — Alexander Talpalatski

(57) ABSTRACT

An electromagnetic contactor including: an arc-extinguishing chamber in which a contact portion is disposed; a case having an arc-extinguishing chamber housing portion in which the arc-extinguishing chamber is housed; and an arc-extinguishing cover mounted on the case and configured to cover the arc-extinguishing chamber housing portion, wherein at least one of the case and the arc-extinguishing cover has a first engaging portion and a second engaging portion, the other has a third engaging portion configured to engage with the first engaging portion and the second engaging portion, and the arc-extinguishing cover is held to the case in either a first state in which the first engaging portion and the third engaging portion are engaged with each other or a second state in which the second engaging portion is engaged with the third engaging portion.

10 Claims, 6 Drawing Sheets

(58) Field of Classification Search
USPC ..... 335/201, 202; 200/293
See application file for complete search history.

(56) References Cited

U.S. PATENT DOCUMENTS

| | | | | |
|---|---|---|---|---|
| 4,883,927 | A * | 11/1989 | Apfelbacher | H01H 50/323 335/161 |
| 5,677,655 | A * | 10/1997 | Hinata | H01H 50/14 335/132 |
| 6,218,634 | B1 * | 4/2001 | Schwartz | H01H 13/562 200/61.54 |
| 6,255,926 | B1 * | 7/2001 | Gundy | H01H 71/128 200/293 |
| 7,633,365 | B2 * | 12/2009 | Harmon | H01H 71/0257 335/8 |
| 8,410,877 | B1 * | 4/2013 | Takaya | H01H 50/045 335/131 |
| 8,436,702 | B2 * | 5/2013 | Naka | H01H 50/323 200/50.33 |
| 8,487,725 | B2 * | 7/2013 | Takaya | H01H 50/02 335/201 |
| 9,887,054 | B2 * | 2/2018 | Tsutsumi | H01H 50/045 |
| 10,764,998 | B2 * | 9/2020 | Naohara | H01H 45/04 |
| 2003/0184988 | A1 * | 10/2003 | Boyd | H01H 85/2045 361/833 |
| 2012/0139672 | A1 | 6/2012 | Takaya et al. | |
| 2015/0187522 | A1 * | 7/2015 | Ahn | H01H 50/048 335/202 |
| 2020/0221573 | A1 * | 7/2020 | Lee | H01R 12/727 |
| 2022/0254579 | A1 * | 8/2022 | Kawashima | H01H 9/0264 |

FOREIGN PATENT DOCUMENTS

| | | |
|---|---|---|
| JP | 200847419 A | 2/2008 |
| JP | 201144287 A | 3/2011 |

OTHER PUBLICATIONS

Written Opinion of the International Searching Authority dated Feb. 16, 2021 from International Application No. PCT/JP2020/043631.

* cited by examiner

ELECTROMAGNETIC CONTACTOR

CROSS-REFERENCE TO RELATED APPLICATION

This application is a continuation application filed under 35 U.S.C. § 111(a) of International Patent Application No. PCT/JP2020/043631, filed on Nov. 24, 2020, which claims foreign priority benefit under 35 U.S.C. § 119 of Japanese Patent Application No. 2020-7663, filed on Jan. 21, 2020, the contents of each of which are incorporated herein by reference.

TECHNICAL FIELD

The present invention relates to an electromagnetic contactor, more particularly to a structure holding an arc-extinguishing cover.

BACKGROUND ART

An electromagnetic contactor includes a lower case and an upper case both of which are formed of a synthetic resin material having insulation properties, and terminal portions each of which has a contact and coil terminals of an electromagnet are fixed to the upper case and contact portions including movable contacts and fixed contacts are housed in an arc-extinguishing chamber in the upper case. In the lower case, the electromagnet that drives the contact portions and a driving lever are housed. In addition, on the upper case, an arc-extinguishing cover covering the contact portions in the arc-extinguishing chamber and terminal covers covering the coil terminals of the electromagnet are mounted.

In this configuration, when abnormally large current flows through the contact portions of the electromagnetic contactor due to a short-circuit accident or the like, there is a possibility that increase in internal pressure of the arc-extinguishing chamber because of generated arc gas causes the arc-extinguishing cover to be blown off.

Accordingly, electromagnetic contactors in which boss shafts that project to the outside from the one end side in the longitudinal direction of a pair of long-side sidewalls of a rectangular arc-extinguishing cover are formed, a pair of boss holes are formed on an upper case, and the arc-extinguishing cover is mounted on the upper case with the pair of boss shafts fitted into the pair of boss holes have been known (for example, JP 2011-44287 A).

An electromagnetic contactor described in JP 2011-44287 A is configured such that, when internal pressure of an arc-extinguishing chamber increases, an arc-extinguishing cover rotating about boss shafts fitted into boss holes of an upper case and being brought to a one-side open state in which the one short-side side of the arc-extinguishing cover is lifted up before the other short-side side cause generated arc gas to be discharged to the outside through a degassing opening and the internal pressure of the arc-extinguishing chamber to be reduced.

SUMMARY OF INVENTION

Technical Problem

However, in the electromagnetic contactor in JP 2011-44287 A, since, even when the arc-extinguishing cover has been brought to the one-side open state, the amount of discharge of arc gas is small and the internal pressure of the arc-extinguishing chamber remains at a high level, the arc-extinguishing cover opens forcefully and is likely to fall off the upper case.

Accordingly, an object of the present invention is to provide an electromagnetic contactor capable of, while discharging arc gas generated in an arc-extinguishing chamber to the outside, surely preventing an arc-extinguishing cover from being blown off.

Solution to Problem

In order to achieve the above-described object, according to an aspect of the present invention, there is provided an electromagnetic contactor including: an arc-extinguishing chamber in which a movable contact and a fixed contact are disposed; a case having an arc-extinguishing chamber housing portion in which the arc-extinguishing chamber is housed; and an arc-extinguishing cover mounted on the case and configured to cover the arc-extinguishing chamber housing portion, wherein at least one of the case and the arc-extinguishing cover has a first engaging portion and a second engaging portion, the other of the case and the arc-extinguishing cover has a third engaging portion configured to engage with the first engaging portion and the second engaging portion, and the arc-extinguishing cover is held to the case in either a first state in which the first engaging portion and the third engaging portion are engaged with each other or a second state in which the second engaging portion is engaged with the third engaging portion.

Advantageous Effects of Invention

An electromagnetic contactor of the present invention can surely prevent an arc-extinguishing cover from being blown off while discharging arc gas generated in an arc-extinguishing chamber to the outside.

DESCRIPTION OF EMBODIMENTS

Next, with reference to the accompanying drawings, an embodiment according to the present invention will be described. In the following description of the drawings, the same or similar reference signs are assigned to the same or similar composing elements. However, it should be noted that the drawings are schematic and relations between thicknesses and planar dimensions, ratios among thicknesses of respective layers, and the like are different from actual ones. Therefore, specific thicknesses and dimensions should be determined in consideration of the following description. It should also be noted that the drawings include portions having different dimensional relationships and ratios from each other.

In addition, the embodiments, which will be described below, indicate a device and a method to embody the technical idea of the present invention by way of example, and the technical idea of the present invention does not limit the materials, shapes, structures, arrangements, and the like of the constituent components to those described below. The technical idea of the present invention can be subjected to a variety of alterations within the technical scope prescribed by the claims described in CLAIMS.

Note that terms indicating directions, such as "upper", "lower", "bottom", "front", "rear", "long length direction", and "short length direction", that are referred to in the following description are used referring to the directions in the accompanying drawings.

First Embodiment

FIGS. 1 to 5 are diagrams illustrative of an electromagnetic contactor 1 of a first embodiment according to the present invention.

Figure 1:
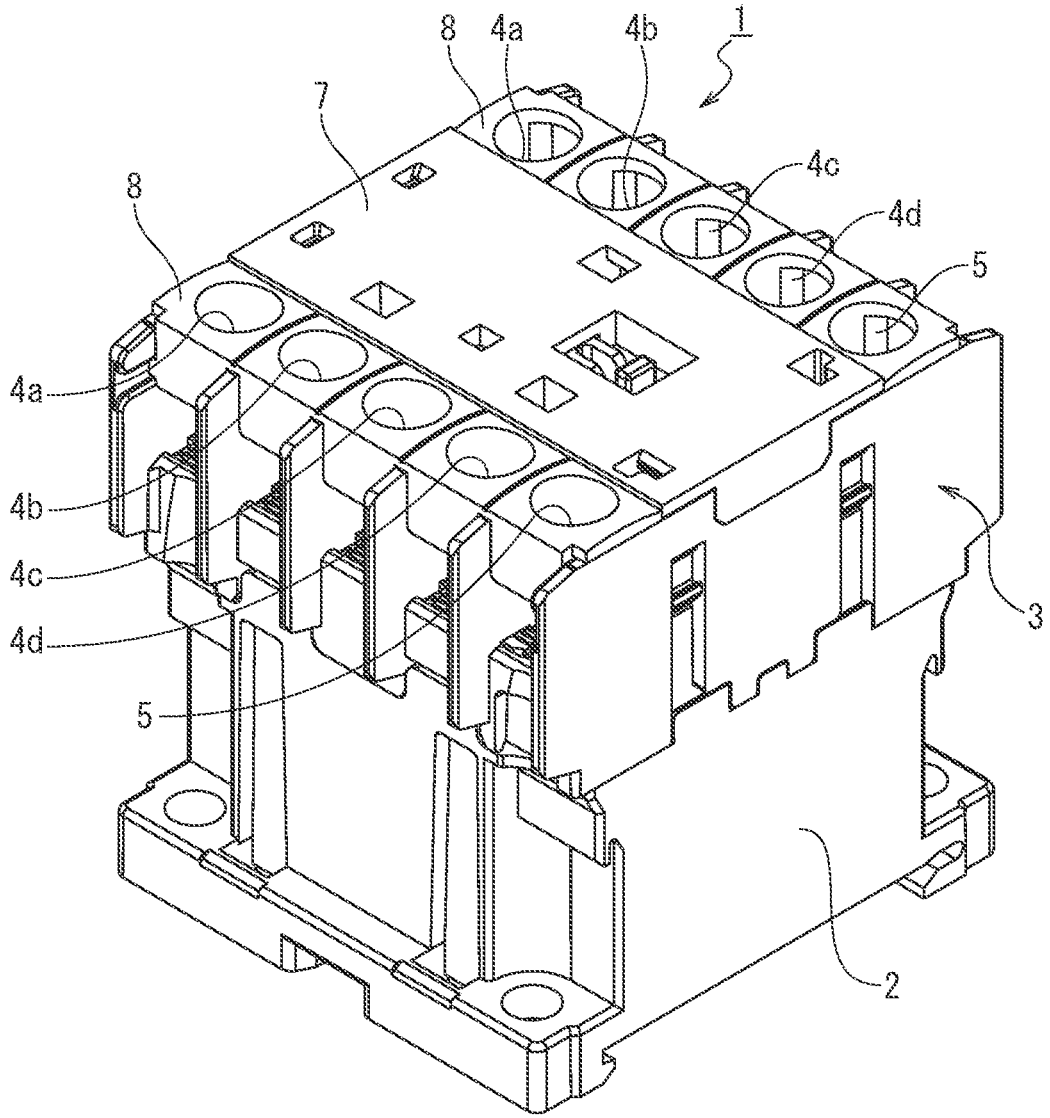
FIG. 1 is a perspective view illustrative of an electromagnetic contactor according to the present invention.

FIG. 1 is a diagram illustrative of an overall configuration of the electromagnetic contactor 1, and the electromagnetic contactor 1 includes a lower case 2 and an upper case 3 that are formed of a synthetic resin material having insulation properties. To the upper case 3, terminal portions 4*a* to 4*d* each of which has a contact and coil terminals 5 of an electromagnet are fixed and an arc-extinguishing cover 7 that covers an arc-extinguishing chamber housing portion 9 housing an arc-extinguishing chamber S, which will be described later, and terminal covers 8 that cover the terminal portions 4*a* to 4*d* and the coil terminals 5 of the electromagnet are mounted. In the lower case 2, the electromagnet (not illustrated) that drives contact portions 6 and a driving lever (not illustrated) are housed.

Figure 2:
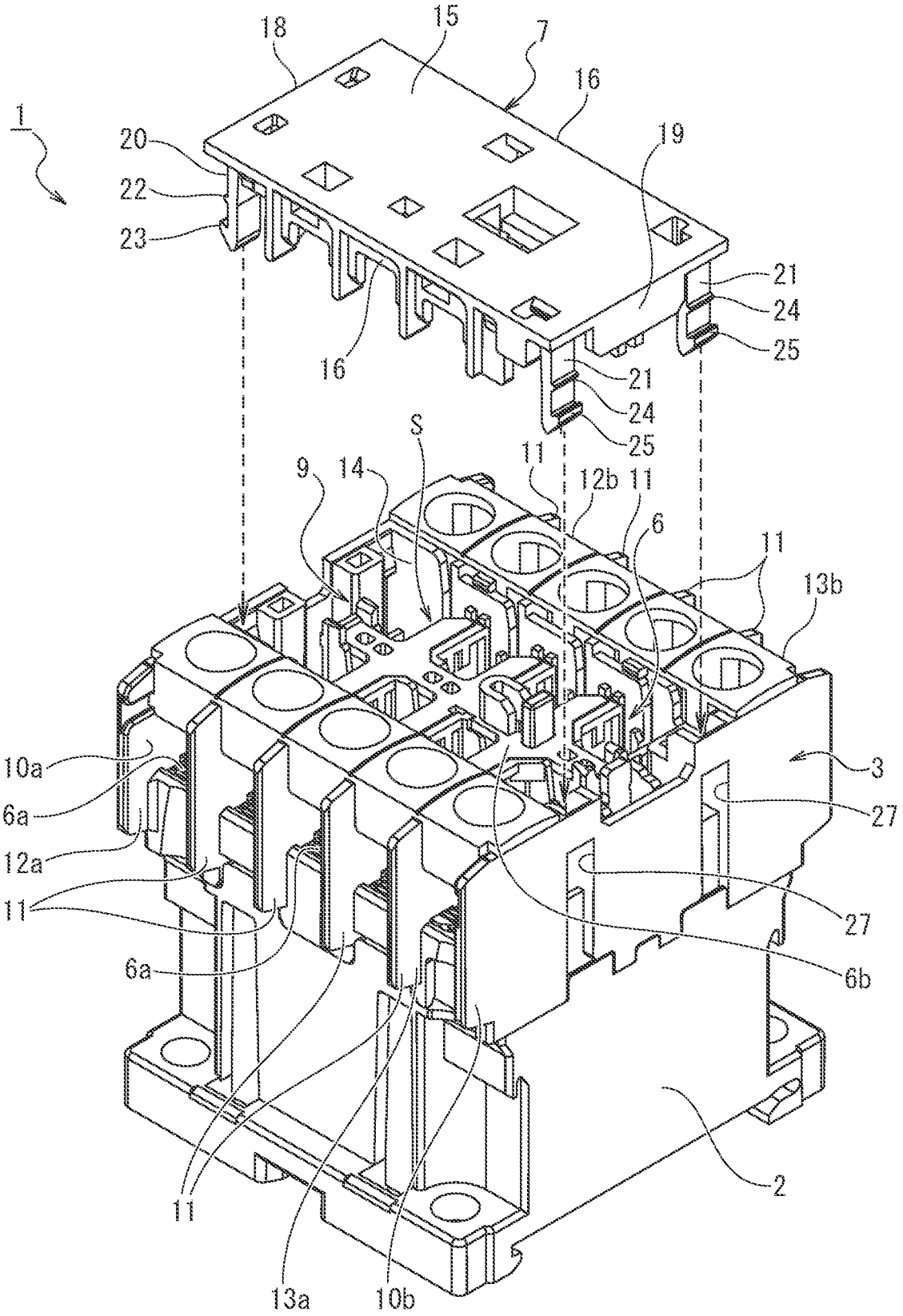
FIG. 2 is a perspective view illustrative of a state in which an arc-extinguishing cover is removed from an upper case in a first embodiment according to the present invention.

FIG. 2 is a diagram illustrative of a state in which the arc-extinguishing cover 7 of the electromagnetic contactor 1 is removed from the upper case 3 thereof. In the upper case 3, a plurality of first main circuit terminal chambers 12*a* and first coil terminal chamber 13*a* and second main circuit terminal chambers 12*b* and second coil terminal chamber 13*b* are formed with the back surface sides thereof facing each other by a pair of case outer walls 10*a* and 10*b* and a plurality of case partition walls 11 partitioning an interspace between the pair of case outer walls 10*a* and 10*b* in a parallel manner, and the arc-extinguishing chamber housing portion 9 is formed by disposing a plurality of case inner walls 14 between the plurality of first main circuit terminal chambers 12*a* and first coil terminal chamber 13*a* and the second main circuit terminal chambers 12*b* and second coil terminal chamber 13*b*. In the arc-extinguishing chamber housing portion 9, the arc-extinguishing chamber S in which the contact portions 6 are formed is housed.

The contact portions 6 include terminal portions 6*a* that respectively have contacts arranged in the first main circuit terminal chambers 12*a* and the second main circuit terminal chambers 12*b*, a movable contact support 6*b* arranged in the arc-extinguishing chamber S, and a return spring (not illustrated) that is arranged at one end in the longitudinal direction of the movable contact support 6*b* and that biases the movable contact support 6*b* toward the other end side in the longitudinal direction of the movable contact support 6*b*.

The other end side in the longitudinal direction of the movable contact support 6*b* is connected to the electromagnet, which is housed in the lower case 2, via the driving lever (not illustrated), and, when an excitation coil (not illustrated) constituting the electromagnet is brought to an energized state, the movable contact support 6*b* moves toward the one end side in the longitudinal direction against the return spring.

As illustrated in FIG. 2, the arc-extinguishing cover 7 includes a rectangular cover body 15 that is located on the front side of the electromagnetic contactor 1 when the electromagnetic contactor 1 is in an attachment position, a pair of long-side wall portions 16 and 16 that are formed facing each other from long-side edge portions of the cover body 15, and a pair of short-side wall portions 18 and 19 that are formed facing each other from short-side edge portions of the cover body 15. The arc-extinguishing cover 7 also includes a pair of engaging leg portions 20 that are formed separated from each other in the short side direction with one short-side wall portion 18 interposed therebetween on one of the short-side edge portions of the cover body 15 and a pair of engaging leg portions 21 that are formed separated from each other in the short side direction with the other short-side wall portion 19 interposed therebetween on the other of the short-side edge portions of the cover body 15. The pair of engaging leg portions 20 and the pair of engaging leg portions 21 are formed along a mounting direction of the arc-extinguishing cover 7 on the upper case 3.

On the base end side and the tip of each of the pair of engaging leg portions 20, which are formed on the one of the short-side edge portions of the cover body 15, a first hook portion 22 that projects to the outside in the longitudinal direction of the cover body 15 and a second hook portion 23 that projects in the same direction as the direction of the first hook portion 22 are formed, respectively. On the base end side and the tip of each of the pair of second engaging leg portions 21, which are formed on the other of the short-side edge portions of the cover body 15, a first hook portion 24 that projects to the outside in the longitudinal direction of the cover body 15 and a second hook portion 25 that projects in the same direction as the direction of the first hook portion 24 are formed, respectively.

Figure 3:
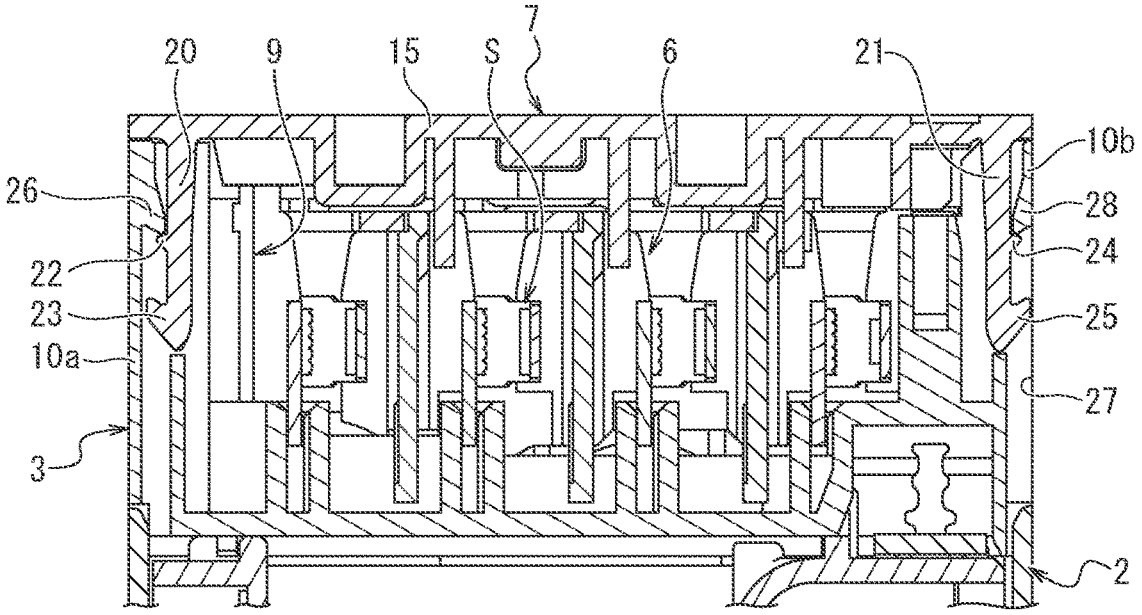
FIG. 3 is a cross-sectional view illustrative of a state in which the arc-extinguishing cover is mounted on the upper case in the first embodiment according to the present invention.

As illustrated in FIG. 3, on the inner wall of the case outer wall 10*a* of the upper case 3, hook engaging portions 26 that engage with the first hook portions 22 and the second hook portions 23 of the pair of engaging leg portions 20 of the arc-extinguishing cover 7 are formed.

On the case outer wall 10*b* of the upper case 3, two slits 27 that extend upward from the lower case 2 side are formed (see FIG. 2), and, at upper edge portions of the slits 27, hook engaging portions 28 that engage with the first hook portions 24 and the second hook portions 25 of the pair of engaging leg portions 21 of the arc-extinguishing cover 7 are formed.

Figure 4A:
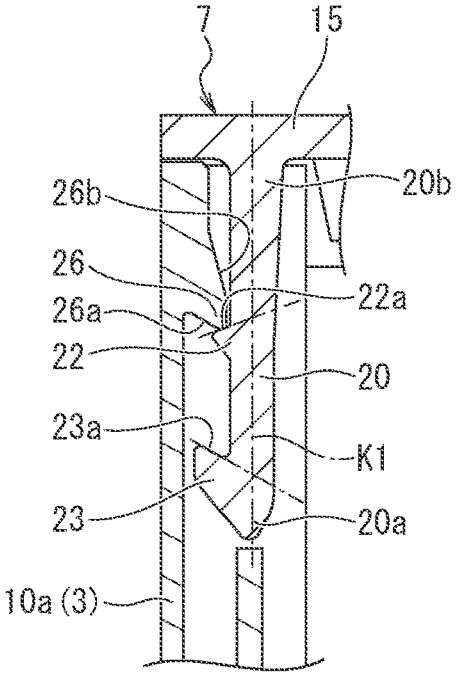
FIGS. 4A and 4B are cross-sectional views of a main part illustrative of a state in which third engaging portions formed on the upper case and first engaging portions formed on the arc-extinguishing cover engage with each other in the first embodiment according to the present invention.

As illustrated in FIG. 4A, the second hook portion 23 disposed at a leg portion tip 20*a* of each of the engaging leg portions 20 is formed in a claw shape that bends from the leg portion tip 20*a* toward a leg portion base end 20*b*, and a second hook inner surface 23*a* of the second hook portion 23, the second hook inner surface 23*a* pointing toward the leg portion base end 20*b*, is formed in a flat surface. When it is assumed that the mounting direction of the engaging leg portion 20 with respect to the upper case 3 is represented by a virtual line illustrated by an alternate long and short dash line and indicated by a reference sign K1, an angle formed by the virtual line K1 and an extension line extending along the second hook inner surface 23*a* is set to an acute angle.

The first hook portion 22, which is disposed on a position closer to the leg portion base end 20*b* than the second hook portion 23, is formed projecting in a triangular cross-sectional shape.

A first hook inner surface 22*a* of the first hook portion 22, the first hook inner surface 22*a* facing the leg portion base end 20*b*, is formed in a flat surface. An angle formed by the virtual line K1 of the engaging leg portion 20 and an extension line extending along the first hook inner surface 22*a* is larger than the angle formed by the virtual line K1 and the extension line extending along the second hook inner surface 23*a* and is set to, for example, an obtuse angle.

The hook engaging portion 26, with which the first hook portion 22 and the second hook portion 23 engage, projects in a triangular cross-sectional shape and has an engaging surface 26*a* formed thereon that meshes with the second hook inner surface 23*a* of the second hook portion 23, which is formed in a claw shape.

A surface (a surface facing the opening portion side of the upper case 3) on the opposite side of the hook engaging portion 26 to the engaging surface 26*a* is formed as a surface (hereinafter, referred to as an inclined surface 26*b*) that is inclined as going from the tip of the engaging surface 26*a* toward the opening portion of the upper case 3.

Figure 4B:
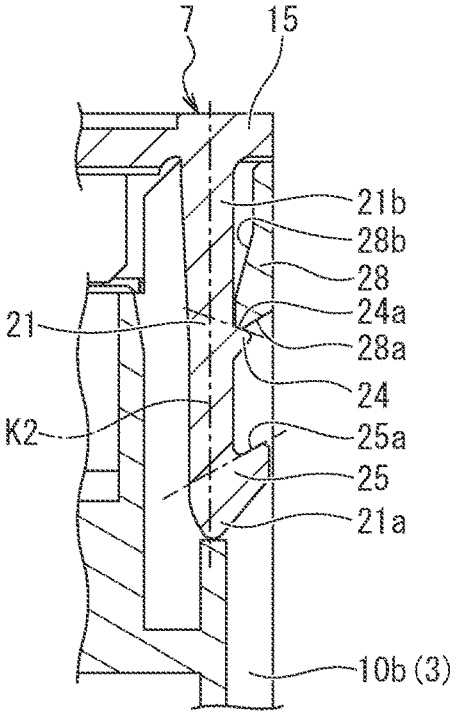

As illustrated in FIG. 4B, the second hook portion 25 disposed at a leg portion tip 21*a* of each of the engaging leg portions 21 is formed in a claw shape that bends from the leg portion tip 21*a* toward a leg portion base end 21*b*, and a second hook inner surface 25*a* of the second hook portion 25, the second hook inner surface 25*a* pointing toward the leg portion base end 21*b*, is formed in a flat surface. When it is assumed that the mounting direction of the engaging leg portion 21 with respect to the upper case 3 is represented by a virtual line illustrated by an alternate long and short dash line and indicated by a reference sign K2, an angle formed by the virtual line K2 and an extension line extending along the second hook inner surface 25*a* is set to an acute angle.

The first hook portion 24, which is disposed on a position closer to the leg portion base end 21*b* than the second hook portion 25, is formed projecting in a triangular cross-sectional shape.

A first hook inner surface 24*a* of the first hook portion 24, the first hook inner surface 24*a* facing the leg portion base end 21*b*, is formed in a flat surface. An angle formed by the virtual line K2 of the engaging leg portion 21 and an extension line extending along the first hook inner surface 24*a* is larger than the angle formed by the virtual line K2 and the extension line extending along the second hook inner surface 25*a* and is set to, for example, an obtuse angle.

The hook engaging portion 28, with which the first hook portion 24 and the second hook portion 25 engage, projects in a triangular cross-sectional shape and has an engaging surface 28*a* formed thereon that meshes with the second hook inner surface 25*a* of the second hook portion 25, which is formed in a claw shape.

A surface (a surface facing the opening portion side of the upper case 3) on the opposite side of the hook engaging portion 28 to the engaging surface 28*a* is formed as a surface (hereinafter, referred to as an inclined surface 28*b*) that is inclined as going from the tip of the engaging surface 28*a* toward the opening portion of the upper case 3.

In this configuration, since the first hook inner surface 22*a* of the first hook portion 22 of each of the engaging leg portions 20 is formed with the angle formed by the first hook inner surface 22*a* and the virtual line K1 larger than the angle formed by the second hook inner surface 23*a* of the second hook portion 23 and the virtual line K1, the engagement of the first hook inner surface 22*a* with the engaging surface 26*a* of one of the hook engaging portions 26 is more easily released than the second hook inner surface 23*a* of the second hook portion 23. Changing the angle formed by the first hook inner surface 22*a* of the first hook portion 22 and the virtual line K1 enables product performance of the electromagnetic contactor 1 to be controlled. That is, bringing the angle formed by the first hook inner surface 22*a* and the virtual line K1 close to an acute angle causes the engagement of the first hook inner surface 22*a* with the engaging surface 26*a* of the hook engaging portion 26 to become less likely to be released and the arc-extinguishing cover 7 to thereby become less likely to be removed, which improves mechanical durability. Conversely, bringing the angle formed by the first hook inner surface 22*a* and the virtual line K1 close to an obtuse angle causes the engagement of the first hook inner surface 22*a* with the engaging surface 26*a* of the hook engaging portion 26 to be immediately released, which improves performance of degassing arc gas generated in the arc-extinguishing chamber S. Since improvement in the performance of degassing of the arc-extinguishing chamber S enables increase in the internal pressure of the arc-extinguishing chamber housing portion 9 to be suppressed, it is possible to suppress ascending velocity of the arc-extinguishing cover 7 and prevent the arc-extinguishing cover 7 from falling off.

In addition, since the first hook inner surface 24*a* of the first hook portion 24 of each of the engaging leg portions 21 is formed with the angle formed by the first hook inner surface 24*a* and the virtual line K2 larger than the angle formed by the second hook inner surface 25*a* of the second hook portion 25 and the virtual line K2, the engagement of the first hook inner surface 24*a* with the engaging surface 28*a* of one of the hook engaging portions 28 is more easily released than the second hook inner surface 25*a* of the second hook portion 25. Changing the angle formed by the first hook inner surface 24*a* of the first hook portion 24 and the virtual line K2, as with the afore-described first hook inner surface 22*a* of the first hook portion 22 of each of the engaging leg portions 20, enables the product performance of the electromagnetic contactor 1 to be controlled.

The arc-extinguishing cover 7 is fitted into the upper case 3 in such a manner as to cover the arc-extinguishing chamber housing portion 9 (in the arrow direction in FIG. 2). On this occasion, as illustrated in FIG. 3, the pair of long-side wall portions 16 slide on the case inner walls 14 of the upper case 3 and enters the arc-extinguishing chamber housing portion 9, and the pair of engaging leg portions 20 and the pair of engaging leg portions 21, while being elastically deformed, slide on the inner surfaces of the pair of case outer walls 10*a* and 10*b* of the upper case 3. The first hook portions 22 of the engaging leg portions 20 engage with the hook engaging portions 26, and the first hook portions 24 of the engaging leg portions 21 engage with the hook engaging portions 28. This configuration causes the arc-extinguishing cover 7 to be mounted on the upper case 3 in such a manner as to cover the arc-extinguishing chamber housing portion 9.

In this configuration, since, when, in order to mount the arc-extinguishing cover 7 on the upper case 3, the engaging leg portions 20 and engaging leg portions 21 of the arc-extinguishing cover 7 are moved in the mounting direction toward the hook engaging portions 26 and 28 of the upper case 3, the second hook portions 23 and the first hook portions 22 slide along the inclined surfaces 26*b* of the hook engaging portions 26 and the engaging leg portions 20 are thereby gradually elastically deformed, it is possible to prevent damage to the engaging leg portions 20 due to local deformation. In addition, since the second hook portions 25 and the first hook portions 24 slide along the inclined surfaces 28*b* of the hook engaging portions 28 and the engaging leg portions 21 are thereby gradually elastically deformed, it is possible to prevent damage to the engaging leg portions 21 due to local deformation.

Since, when the hook engaging portions 26 have engaged with the first hook inner surfaces 22*a* of the first hook portions 22 and the mounting of the engaging leg portion 20 side of the arc-extinguishing cover 7 on the upper case 3 has been completed, a sound coming from the engaging leg portions 20, the elastic deformation of which has been removed, coming into contact with the tips of the hook engaging portions 26 occurs, it is possible to easily confirm the completion of the mounting of the arc-extinguishing cover 7. In addition, since, when the hook engaging portions 28 have engaged with the first hook inner surfaces 24*a* of the first hook portions 24 and the mounting of the engaging leg portion 21 side of the arc-extinguishing cover 7 on the upper case 3 has been completed, a sound coming from the engaging leg portions 21, the elastic deformation of which has been removed, coming into contact with the tips of the hook engaging portions 28 occurs, it is possible to easily confirm the completion of the mounting of the arc-extinguishing cover 7.

In the electromagnetic contactor 1, which includes the upper case 3 and the arc-extinguishing cover 7 having the above-described configuration, abnormally large current flowing through the contact portions 6 due to a short-circuit accident or the like and generated arc gas excessively increasing internal pressure of the arc-extinguishing chamber S cause the arc-extinguishing cover 7 to be separated from the upper case 3 and to be lifted up.

Figure 5A:
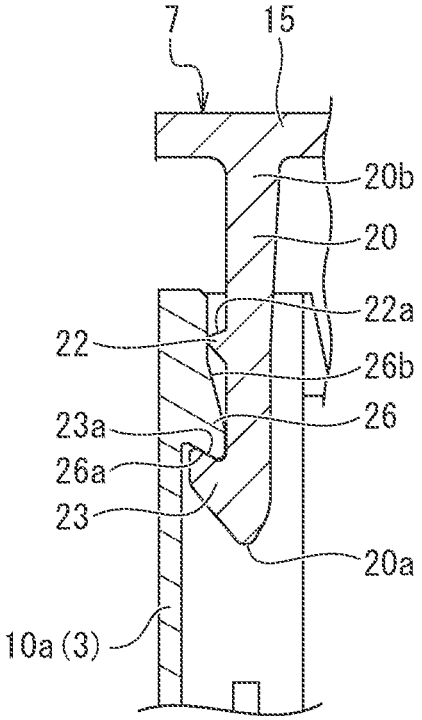
FIGS. 5A and 5B are cross-sectional views of a main part illustrative of a state in which the third engaging portions formed on the upper case and second engaging portions formed on the arc-extinguishing cover engage with each other in the first embodiment according to the present invention.
Figure 5B:
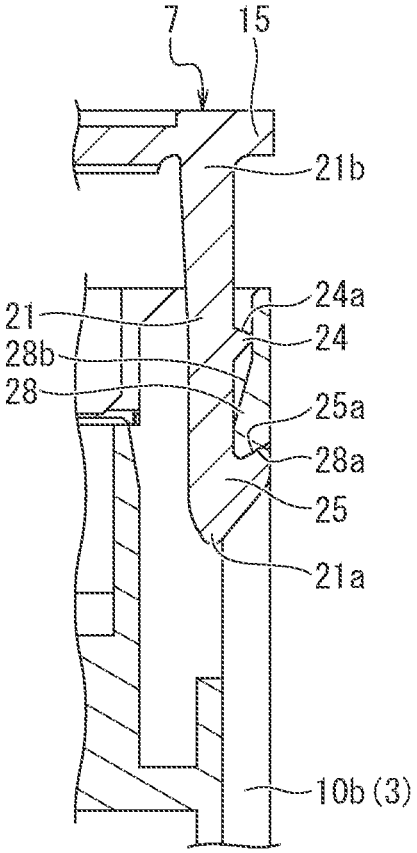

When the internal pressure of the arc-extinguishing chamber S excessively increases, the engaging leg portions 20 being elastically deformed to the right-hand side causes the hook engaging portions 26 to move to the peak portions of the triangular cross-sections of the first hook portions 22 and the engaged state of the hook engaging portions 26 with the first hook portions 22 to be released, and the engaging leg portions 21 being elastically deformed to the left-hand side causes the hook engaging portions 28 to move to the peak portions of the triangular cross-sections of the first hook portions 24 and the engaged state of the hook engaging portions 28 with the first hook portions 24 to be released. The arc-extinguishing cover 7 being lifted up with respect to the upper case 3 causes the second hook inner surfaces 23*a* of the second hook portions 23 of the engaging leg portions 20 to mesh with the engaging surfaces 26*a* of the hook engaging portions 26 and the engagement between the second hook portions 23 and the hook engaging portions 26 to be thereby maintained, as illustrated in FIG. 5A, and causes the second hook inner surfaces 25*a* of the second hook portions 25 of the engaging leg portions 21 to mesh with the engaging surfaces 28*a* of the hook engaging portions 28 and the engagement between the second hook portions 25 and the hook engaging portions 28 to be thereby maintained, as illustrated in FIG. 5B. This configuration causes a gap to be formed between the pair of long-side wall portions 16 and 16 and pair of short-side wall portions 18 and 19 of the arc-extinguishing cover 7 and the case outer walls 10*a* and 10*b* and case inner walls 14 of the upper case 3, that is, at the entire circumference of the cover body 15, and arc gas in the arc-extinguishing chamber S is discharged to the outside with the gap serving as a degassing opening and the internal pressure of the arc-extinguishing chamber S is decreased, which enables the arc-extinguishing cover 7 to be prevented from being blown off.

Therefore, the arc-extinguishing cover 7 of the present embodiment has the first hook portions 22 and 24 and the second hook portions 23 and 25 formed thereon that have weak engagement force and strong engagement force, respectively, with respect to the hook engaging portions 26 and 28, which are formed on the upper case 3, and is mounted on the upper case 3 with the first hook portions 22 and 24 engaged with the hook engaging portions 26 and 28, and, when the internal pressure of the arc-extinguishing chamber S excessively increases due to arc gas, it is possible to, by releasing the engagement of the first hook portions 22 and 24, which has weak engagement force, with the hook engaging portions 26 and 28 and thereby lifting up the arc-extinguishing cover 7, surely discharge the arc gas in the arc-extinguishing chamber S to the outside. Engaging the second hook portions 23 and 25, which have strong engagement force, with the hook engaging portions 26 and 28 enables the arc-extinguishing cover 7 to be surely prevented from being blown off from the upper case 3.

In addition, since the arc-extinguishing cover 7 of the present embodiment is a member that has a simple structure in which the pair of engaging leg portions 20 and the pair of engaging leg portions 21 that extend from the cover body 15, the second hook portions 23 and 25 that are formed at the leg portion tips 20*a* and 21*a* of the engaging leg portions 20 and 21, respectively, and the first hook portions 22 and 24 that are formed on positions closer to the leg portion base ends 20*b* and 21*b* than the second hook portions 23 and 25, respectively, are integrally formed, it is possible to reduce production cost and miniaturize the electromagnetic contactor 1 because a large attachment space is not required to attach the arc-extinguishing cover 7 to the upper case 3.

In addition, the second hook portions 23 and 25 of the engaging leg portions 20 and 21 and the hook engaging portions 26 and 28 of the upper case 3 are preferably formed in a claw shape instead of a shape extending at the right angle with respect to the mounting direction of the arc-extinguishing cover 7. The arc-extinguishing cover 7 that is lifted up because of excessively increased internal pressure of the arc-extinguishing chamber S is brought to a state in which the cover body 15 has a central portion bulging out upward and largely bends. When the arc-extinguishing cover 7 is caused to be lifted up with the cover body 15 largely bending as described above, the arc-extinguishing cover 7 is capable of engaging with the upper case 3 with the engaging surfaces 26*a* and 28*a* of the hook engaging portions 26 and 28, which are formed to the upper case 3, meshing with at least the tips of the second hook inner surfaces 23*a* and 25*a* of the claw-shaped second hook portions 23 and 25. Therefore, even when the arc-extinguishing cover 7 is lifted up with the cover body 15 largely bending, it is possible to increase engagement force of the second hook portions 23 and 25 with respect to the hook engaging portions 26 and 28 and thereby prevent the arc-extinguishing cover 7 from being blown off from the upper case 3, more surely.

Second Embodiment

Figure 6:
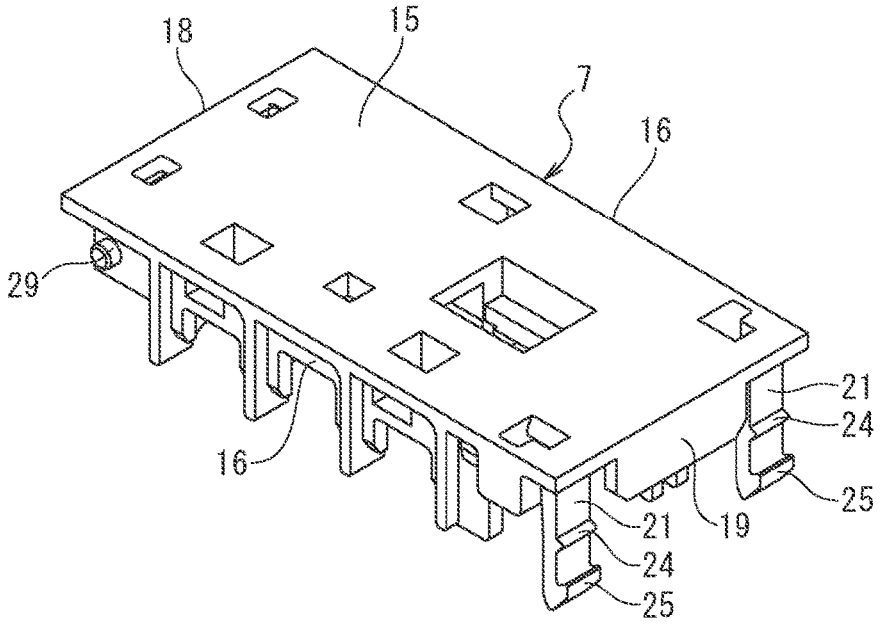
FIG. 6 is a perspective view illustrative of a shape of an arc-extinguishing cover of a second embodiment according to the present invention.
Figure 7:
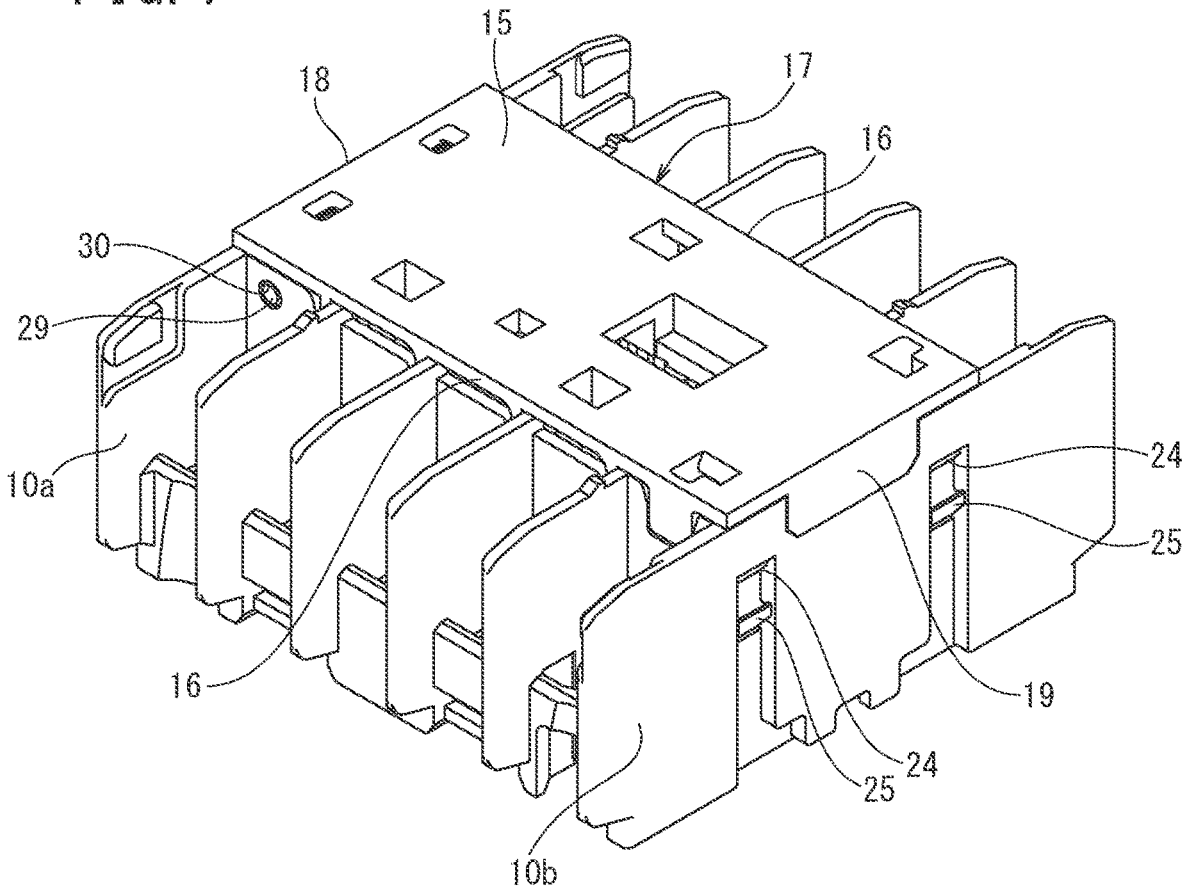
FIG. 7 is a perspective view illustrative of the arc-extinguishing cover and an upper case of the second embodiment according to the present invention.

Next, FIGS. 6 and 7 are diagrams illustrative of a main portion of an electromagnetic contactor 1 of a second embodiment according to the present invention. Note that the same reference signs are assigned to the same constituent components as those in the structure of the first embodiment and a description thereof will be omitted.

On an arc-extinguishing cover 7 of the second embodiment, a pair of engaging leg portions 20 described in the first embodiment are not formed, and, instead, a pair of boss shafts 29 are formed projecting outward at positions close to one short-side wall portion 18 on a pair of long-side wall portions 16. On an upper case 3 of the second embodiment, hook engaging portions 26 described in the first embodiment are not formed to the inner wall of one case outer wall 10*a*, and, instead, a pair of boss holes 30 into which the pair of boss shafts 29 of the arc-extinguishing cover 7 are fitted are formed at positions close to the one case outer wall 10*a*.

In the electromagnetic contactor 1, which includes the arc-extinguishing cover 7 and the upper case 3 having the above-described configuration, abnormally large current flowing through contact portions 6 due to a short-circuit accident or the like and generated arc gas excessively increasing internal pressure of an arc-extinguishing chamber S cause the arc-extinguishing cover 7 to be separated from the upper case 3 and to be lifted up.

When the internal pressure of the arc-extinguishing chamber S excessively increases, engaging leg portions 21 of the arc-extinguishing cover 7 being elastically deformed to the left-hand side causes hook engaging portions 28 to move to the peak portions of triangular cross-sections of the first hook portions 24 and the engaged state of the hook engaging portions 28 with the first hook portions 24 to be released, and the arc-extinguishing cover 7 rotating about the boss shafts 29 fitted into the boss holes 30 causes the other short-side wall portion 19 side of the arc-extinguishing cover 7 to be lifted up.

As described above, when the other short-side wall portion 19 side of the arc-extinguishing cover 7 is lifted up, a gap is formed between the lower edge surface of the other short-side wall portion 19 and the upper edge surface of the other case outer wall 10*b*, and arc gas in the arc-extinguishing chamber S is discharged to the outside with the gap serving as a degassing opening and the internal pressure of the arc-extinguishing chamber S is decreased, which enables the arc-extinguishing cover 7 to be prevented from being blown off.

Therefore, the electromagnetic contactor 1 including the upper case 3 and the arc-extinguishing cover 7 of the present embodiment has the first hook portions 24 and the second hook portions 25 formed on the arc-extinguishing cover 7, the first hook portions 24 and the second hook portions 25 having weak engagement force and strong engagement force, respectively, with respect to the hook engaging portions 28 formed on the upper case 3, and has the arc-extinguishing cover 7 mounted on the upper case 3 with the first hook portions 24 engaged with the hook engaging portions 28, and, since, when the internal pressure of the arc-extinguishing chamber S excessively increases due to arc gas, the engagement of the first hook portions 24, which have weak engagement force, of the arc-extinguishing cover 7 with the hook engaging portions 28 being released, the second hook portions 25, which have strong engagement force, of the arc-extinguishing cover 7 engaging with the hook engaging portions 28, and the arc-extinguishing cover 7 rotating about the boss shafts 29, which are fitted into the boss holes 30, and being lifted up cause arc gas in the arc-extinguishing chamber S to be surely discharged to the outside, it is possible to surely prevent the arc-extinguishing cover 7 from being blown off from the upper case 3.

In addition, since, when the internal pressure of the arc-extinguishing chamber S excessively increases due to arc gas, the second hook portions 25, which have strong engagement force, engaging with the hook engaging portions 28 causes the arc-extinguishing cover 7 to be prevented from opening forcefully, the boss shafts 29 of the arc-extinguishing cover 7 and the boss holes 30 of the upper case 3 do not have to be formed in such a way as to attain high strength, which enables reduction in component cost to be achieved.

Third Embodiment

Next, FIGS. 8A, 8B, 9A and 9B are diagrams illustrative of a main portion of an electromagnetic contactor 1 of a third embodiment according to the present invention. Note that, in the third embodiment, the same reference signs are assigned to the same constituent components as those in the structure of the first embodiment and a description thereof will be omitted, as well.

Figure 8A:
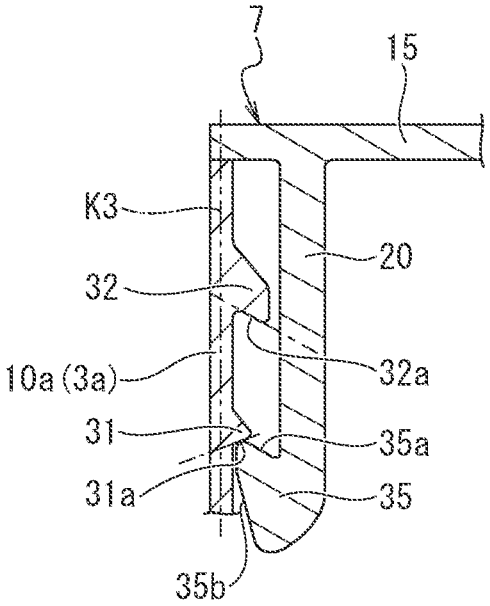
FIGS. 8A and 8B are cross-sectional views of a main part illustrative of a state in which first engaging portions formed on an upper case and third engaging portions formed on an arc-extinguishing cover engage with each other in a third embodiment according to the present invention.
Figure 8B:
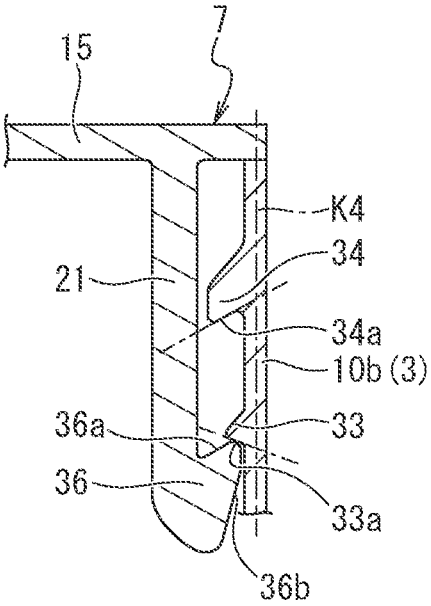

As illustrated in FIG. 8A, on one case outer wall 10*a* of an upper case 3 of the present embodiment, first hook portions 31 are formed at positions apart from an opening portion on the inner wall and second hook portions 32 are formed on a position closer to the opening portion than the first hook portions 31. In addition, as illustrated in FIG. 8B, on the other case outer wall 10*b* of an upper case 3 of the present embodiment, first hook portions 33 are formed at positions apart from the opening portion on the inner wall and second hook portions 34 are formed on a position closer to the opening portion than the first hook portions 33.

As illustrated in FIG. 8A, at the tips of engaging leg portions 20 formed on the one short-side wall portion side of an arc-extinguishing cover 7, hook engaging portions 35 that engage with the first hook portions 31 and the second hook portions 32, which are formed on the one case outer wall 10*a* of the upper case 3, are formed. In addition, as illustrated in FIG. 8B, at the tips of engaging leg portions 21 formed on the other short-side wall portion side of the arc-extinguishing cover 7, hook engaging portions 36 that engage with the first hook portions 33 and the second hook portions 34, which are formed on the other case outer wall 10*b* of the upper case 3, are formed.

As illustrated in FIG. 8A, each of the second hook portions 32 formed on the case outer wall 10*a* of the upper case 3 is formed in a claw shape that bends in a direction going away from the opening portion of the upper case 3, and a second hook inner surface 32*a* on the opposite side to the opening portion is formed in a flat surface. When it is assumed that the mounting direction of the engaging leg portion 20 with respect to the upper case 3 is represented by a virtual line illustrated by an alternate long and short dash line and indicated by a reference sign K3, an angle formed by the virtual line K3 and an extension line extending along the second hook inner surface 32*a* is set to an acute angle.

Each of the first hook portions 31, which is formed at a position further apart from the opening portion of the upper case 3 than the second hook portion 32, is formed projecting in a triangular cross-sectional shape. A first hook inner surface 31*a* on the opposite side of the first hook portion 31 to the opening portion of the upper case 3 is formed in a flat surface. An angle formed by the virtual line K3 and an extension line extending along the first hook inner surface 31*a* is larger than the angle formed by the virtual line K3 and the extension line extending along the second hook inner surface 32*a* and is set to, for example, an obtuse angle.

Each of the hook engaging portions 35, with which the first hook portion 31 and the second hook portion 32 engage, projects in a triangular cross-sectional shape and has an engaging surface 35*a* formed thereon that meshes with the second hook inner surface 32*a* of the second hook portion 32, which is formed in a claw shape. A surface on the opposite side of the hook engaging portion 35 to the engaging surface 35*a* is formed as a surface (hereinafter, referred to as an inclined surface 35*b*) that is inclined from the tip of the engaging surface 35*a* in a direction going away from the opening portion of the upper case 3.

In addition, as illustrated in FIG. 8B, each of the second hook portions 34 formed on the case outer wall 10*b* of the upper case 3 is formed in a claw shape that bends in a direction going away from the opening portion of the upper case 3, and a second hook inner surface 34*a* on the opposite side to the opening portion is formed in a flat surface. When it is assumed that the mounting direction of the engaging leg portion 21 with respect to the upper case 3 is represented by a virtual line illustrated by an alternate long and short dash line and indicated by a reference sign K4, an angle formed by the virtual line K4 and an extension line extending along the second hook inner surface 34*a* is set to an acute angle.

Each of the first hook portions 33, which is formed at a position further apart from the opening portion of the upper case 3 than the second hook portion 34, is formed projecting in a triangular cross-sectional shape. A first hook inner surface 33*a* on the opposite side of the first hook portion 33 to the opening portion of the upper case 3 is formed in a flat surface. An angle formed by the virtual line K4 and an extension line extending along the first hook inner surface 33*a* is larger than the angle formed by the virtual line K4 and the extension line extending along the second hook inner surface 34*a* and is set to, for example, an obtuse angle.

Each of the hook engaging portions 36, with which the first hook portion 33 and the second hook portion 34 engage, projects in a triangular cross-sectional shape and has an engaging surface 36*a* formed thereon that meshes with the second hook inner surface 34*a* of the second hook portion 34, which is formed in a claw shape. A surface on the opposite side of the hook engaging portion 36 to the engaging surface 36*a* is formed as a surface (hereinafter, referred to as an inclined surface 36*b*) that is inclined from the tip of the engaging surface 36*a* in a direction going away from the opening portion of the upper case 3.

In this configuration, since the first hook inner surface 31*a* of the first hook portion 31, which is formed on the case outer wall 10*a*, is formed with the angle formed by the first hook inner surface 31*a* and the virtual line K3 larger than the angle formed by the second hook inner surface 32*a* of the second hook portion 32 and the virtual line K3, the engagement of the first hook inner surface 31*a* with the engaging surface 35*a* of the hook engaging portion 35 is more easily released than the second hook inner surface 32*a* of the second hook portion 32. Changing the angle formed by the first hook inner surface 31*a* of the first hook portion 31 and the virtual line K3 enables product performance of the electromagnetic contactor 1 to be controlled. That is, bringing the angle formed by the first hook inner surface 31*a* and the virtual line K3 close to an acute angle causes the engagement of the first hook inner surface 31*a* with the engaging surface 35*a* of the hook engaging portion 35 to become less likely to be released and the arc-extinguishing cover 7 to thereby become less likely to be removed, which improves mechanical durability. Conversely, bringing the angle formed by the first hook inner surface 31*a* and the virtual line K3 close to an obtuse angle causes the engagement of the first hook inner surface 31*a* with the engaging surface 35*a* of the hook engaging portion 35 to be immediately released, which improves performance of degassing arc gas generated in the arc-extinguishing chamber S. Since improvement in the performance of degassing of the arc-extinguishing chamber S enables increase in the internal pressure of the arc-extinguishing chamber S to be suppressed, it is possible to suppress ascending velocity of the arc-extinguishing cover 7 and prevent the arc-extinguishing cover 7 from falling off.

In addition, since the first hook inner surface 33*a* of the first hook portion 33, which is formed on the case outer wall 10*b*, is formed with the angle formed by the first hook inner surface 33*a* and the virtual line K4 larger than the angle formed by the second hook inner surface 34*a* of the second hook portion 34 and the virtual line K4, the engagement of the first hook inner surface 33*a* with the engaging surface 36*a* of the hook engaging portion 36 is more easily released than the second hook inner surface 34*a* of the second hook portion 34. Changing the angle formed by the first hook inner surface 33*a* of the first hook portion 33 and the virtual line K4, as with the afore-described first hook inner surface 31*a* of the first hook portion 31 formed on the case outer wall 10*a*, enables product performance of the electromagnetic contactor 1 to be controlled.

The arc-extinguishing cover 7 is mounted on the upper case 3 while covering the arc-extinguishing chamber housing portion 9. On this occasion, since, when the engaging leg portions 20 and the engaging leg portions 21 of the arc-extinguishing cover 7 are moved in the mounting direction along the case outer walls 10*a* and 10*b* of the upper case 3, the inclined surfaces 35*b* of the hook engaging portions 35 of the engaging leg portions 20 slide on the second hook portions 32 and first hook portions 31 of the case outer wall 10*a*, the engaging leg portions 20 are gradually elastically deformed, which enables damage to the engaging leg portions 20 due to local deformation to be prevented. In addition, since the inclined surfaces 36*b* of the hook engaging portions 36 of the engaging leg portions 21 slide on the second hook portions 34 and first hook portions 33 of the case outer wall 10*b*, the engaging leg portions 21 are gradually elastically deformed, which enables damage to the engaging leg portions 21 due to local deformation to be prevented.

Since, when the hook engaging portions 35 have engaged with the first hook inner surfaces 31*a* of the first hook portions 31 and the mounting of the engaging leg portion 20 side of the arc-extinguishing cover 7 on the upper case 3 has been completed, a sound coming from the engaging leg portions 20, the elastic deformation of which has been removed, coming into contact with the first hook portions 31 occurs, it is possible to easily confirm the completion of the mounting of the arc-extinguishing cover 7. In addition, since, when the hook engaging portions 36 have engaged with the first hook inner surfaces 33*a* of the first hook portions 33 and the mounting of the engaging leg portion 21 side of the arc-extinguishing cover 7 on the upper case 3 has been completed, a sound coming from the engaging leg portions 21, the elastic deformation of which has been removed, coming into contact with the first hook portions 33 occurs, it is possible to easily confirm the completion of the mounting of the arc-extinguishing cover 7.

Figure 9A:
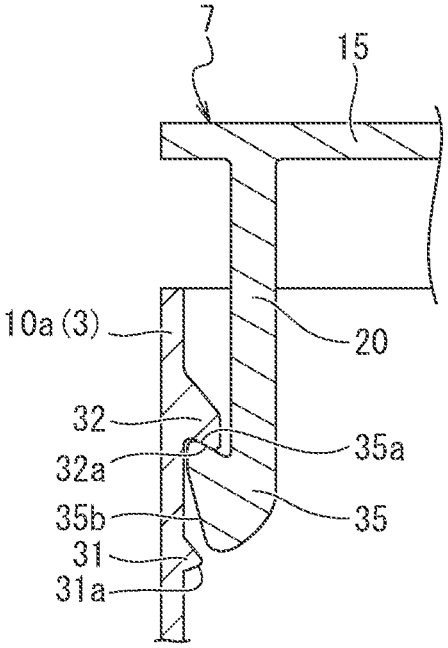
FIGS. 9A and 9B are cross-sectional views of a main part illustrative of a state in which second engaging portions formed on the upper case and the third engaging portions formed on the arc-extinguishing cover engage with each other in the third embodiment according to the present invention.
Figure 9B:
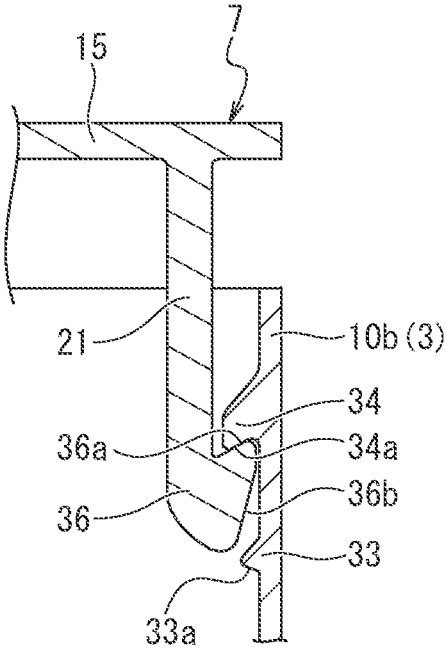

In the electromagnetic contactor 1 including the upper case 3 and the arc-extinguishing cover 7 having the above-described configuration, when the internal pressure of the arc-extinguishing chamber S excessively increases, the engaging leg portions 20 being elastically deformed to the right-hand side causes the hook engaging portions 35 to move to the peak portions of the triangular cross-sections of the first hook portions 31 and the engaged state of the hook engaging portions 35 with the first hook portions 31 to be released, and the engaging leg portions 21 being elastically deformed to the left-hand side causes the hook engaging portions 36 to move to the peak portions of the triangular cross-sections of the first hook portions 33 and the engaged state of the hook engaging portions 36 with the second hook portions 33 to be released. The arc-extinguishing cover 7 being lifted up with respect to the upper case 3 causes the hook engaging portions 35 of the engaging leg portions 20 to mesh with the second hook inner surfaces 32*a* of the second hook portions 32 of the case outer wall 10*a* and the engagement between the second hook portions 32 and the hook engaging portions 35 to be maintained, as illustrated in FIG. 9A, and causes the hook engaging portions 36 of the engaging leg portions 21 to mesh with the second hook inner surfaces 34*a* of the second hook portions 34 of the case outer wall 10*b* and the engagement between the second hook portions 34 and the hook engaging portions 36 to be maintained, as illustrated in FIG. 9B. This configuration causes a gap to be formed at the entire circumference of a cover body 15 with respect to the arc-extinguishing cover 7, and arc gas in the arc-extinguishing chamber S is discharged to the outside with the gap serving as a degassing opening and the internal pressure of the arc-extinguishing chamber S is decreased, which enables the arc-extinguishing cover 7 to be prevented from being blown off.

Therefore, the upper case 3 of the present embodiment has the first hook portions 31 and 33 and the second hook portions 32 and 34 formed on the case outer walls 10*a* and 10*b* thereof, the first hook portions 31 and 33 and the second hook portions 32 and 34 having weak engagement force and strong engagement force, respectively, with respect to the hook engaging portions 35 and 36, which are formed on the engaging leg portions 20 and 21, respectively, of the arc-extinguishing cover 7 of the present embodiment, and the arc-extinguishing cover 7 is mounted on the upper case 3 with the first hook portions 31 and 33 engaged with the hook engaging portions 35 and 36, respectively, and, when the internal pressure of the arc-extinguishing chamber S excessively increases due to arc gas, it is possible to, by releasing the engagement of the first hook portions 31 and 33, which have weak engagement force, with the hook engaging portions 35 and 36 and thereby lifting up the arc-extinguishing cover 7, surely discharge the arc gas in the arc-extinguishing chamber S to the outside. Engaging the second hook portions 32 and 34, which have strong engagement force, with the hook engaging portions 35 and 36 enables the arc-extinguishing cover 7 to be surely prevented from being blown off from the upper case 3.

The hook engaging portions 35 and 36 of the engaging leg portions 20 and 21 and the second hook portions 32 and 34 of the upper case 3 are preferably formed in a claw shape instead of a shape extending at the right angle with respect to the mounting direction of the arc-extinguishing cover 7. The arc-extinguishing cover 7 that is lifted up because of excessively increased internal pressure of the arc-extinguishing chamber S is brought to a state in which the cover body 15 has a central portion bulging out upward and largely bends. When the arc-extinguishing cover 7 is caused to be lifted up with the cover body 15 largely bending as described above, the arc-extinguishing cover 7 is capable of engaging with the upper case 3 with the engaging surfaces 35*a* and 36*a* of the hook engaging portions 35 and 36 meshing with at least the tips of the second hook inner surfaces 32*a* and 34*a* of the claw-shaped second hook portions 32 and 34. Therefore, even when the arc-extinguishing cover 7 is lifted up with the cover body 15 largely bending, it is possible to increase engagement force of the second hook portions 32 and 34 with respect to the hook engaging portions 35 and 36 and thereby prevent the arc-extinguishing cover 7 from being blown off from the upper case 3, more surely.

REFERENCE SIGNS LIST

1 Electromagnetic contactor
2 Lower case
3 Upper case (case)
4*a* to 4*d* Terminal portion
5 Coil terminal
6 Contact portion (movable contact and fixed contact)
6*a* Terminal portion
6*b* Movable contact support
7 Arc-extinguishing cover
8 Terminal cover
9 Arc-extinguishing chamber housing portion
10*a*, 10*b* Case outer wall
11 Case partition wall
12*a* First main circuit terminal chamber
12*b* Second main circuit terminal chamber
13*a* First coil terminal chamber
13*b* Second coil terminal chamber
14 Case inner wall
15 Cover body
16 Long-side wall portion
18, 19 Short-side wall portion
20 Engaging leg portion
20*a* Leg portion tip
20*b* Leg portion base end
21 Engaging leg portion
21*a* Leg portion tip
21*b* Leg portion base end
22 First hook portion (first engaging portion)
22*a* First hook inner surface (first engaging surface)
23 Second hook portion (second engaging portion)
23*a* Second hook inner surface (second engaging surface)
24 First hook portion (first engaging portion)
24*a* Hook inner surface (first engaging surface)
25 Second hook portion (second engaging portion)
25*a* Second hook inner surface (second engaging surface)
26 Hook engaging portion (third engaging portion)
26*a* Engaging surface
26*b* Inclined surface
27 Slit
28 Hook engaging portion (third engaging portion)
28*a* Engaging surface
28*b* Inclined surface
29 Boss shaft
30 Boss hole

31 First hook portion (first engaging portion)
31*a* First hook inner surface (first engaging surface)
32 Second hook portion (second engaging portion)
32*a* Second hook inner surface (second engaging surface)
33 First hook portion (first engaging portion)
33*a* First hook inner surface (first engaging surface)
34 Second hook portion (second engaging portion)
34*a* Second hook inner surface (second engaging surface)
35 Hook engaging portion (second engaging portion)
35*a* Engaging surface
35*b* Inclined surface
36 Hook engaging portion (second engaging portion)
36*a* Engaging surface
36*b* Inclined surface
S Arc-extinguishing chamber

The invention claimed is:

1. An electromagnetic contactor comprising:

an arc-extinguishing chamber in which a movable contact and a fixed contact are disposed;

a case having an arc-extinguishing chamber housing portion in which the arc-extinguishing chamber is housed; and an arc-extinguishing cover mounted on the case and configured to cover the arc-extinguishing chamber housing portion, wherein at least one of the case and the arc-extinguishing cover has a first engaging portion and a second engaging portion, the other of the case and the arc-extinguishing cover has a third engaging portion configured to engage with the first engaging portion and the second engaging portion, and the arc-extinguishing cover is held to the case in either a first state in which the first engaging portion and the third engaging portion are engaged with each other or a second state in which the second engaging portion is engaged with the third engaging portion.

2. The electromagnetic contactor according to claim 1, wherein the arc-extinguishing cover is mounted on the case in the first state, and in the second state, a gap is formed between the arc-extinguishing cover and the case.

3. The electromagnetic contactor according to claim 1, wherein engagement force between the engaging portions in the first state is weaker than engagement force between the engaging portions in the second state.

4. The electromagnetic contactor according to claim 1, wherein a first angle formed by a virtual line representing a mounting direction of the arc-extinguishing cover and a second engaging surface of the second engaging portion is an acute angle, and a second angle formed by the virtual line and a first engaging surface of the first engaging portion is larger than the first angle.

5. The electromagnetic contactor according to claim 4, wherein a third angle formed by the virtual line and a third engaging surface of the third engaging portion is an acute angle.

6. The electromagnetic contactor according to claim 5, wherein an opposite surface of the third engaging portion to the third engaging surface is formed in an inclined surface on which the first engaging portion slides.

7. The electromagnetic contactor according to claim 1, wherein the first to third engaging portions are respectively formed on two opposing edges of the arc-extinguishing cover and two opposing edges of the case coming into contact with the two opposing edges of the arc-extinguishing cover.

8. The electromagnetic contactor according to claim 1, wherein the first to third engaging portions are formed on one edge of the arc-extinguishing cover and one edge of the case, the one edge coming into contact with the one edge of the arc-extinguishing cover, and the other edge of the arc-extinguishing cover is axially supported at the other edge of the case, the other edge being in contact with the other edge of the arc-extinguishing cover, in a freely swingable manner.

9. The electromagnetic contactor according to claim 1, wherein the first engaging portion and the second engaging portion are formed on the arc-extinguishing cover and the third engaging portion is formed on the case.

10. The electromagnetic contactor according to claim 1, wherein the first engaging portion and the second engaging portion are formed on the case and the third engaging portion is formed on the arc-extinguishing cover.

* * * * *